US012522903B2

(12) United States Patent
Lee et al.

(10) Patent No.: US 12,522,903 B2
(45) Date of Patent: Jan. 13, 2026

(54) AUSTENITIC STAINLESS STEEL WITH EXCELLENT CORROSION RESISTANCE OF WELDED PART

(71) Applicant: POSCO, Pohang-si (KR)

(72) Inventors: Jae-Hwa Lee, Pohang-si (KR); Bong-Wn Kim, Pohang-si (KR); Gyu Jin Jo, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 615 days.

(21) Appl. No.: 17/614,841

(22) PCT Filed: May 29, 2020

(86) PCT No.: PCT/KR2020/007052
§ 371 (c)(1),
(2) Date: Nov. 29, 2021

(87) PCT Pub. No.: WO2020/242267
PCT Pub. Date: Dec. 3, 2020

(65) Prior Publication Data

US 2022/0228246 A1 Jul. 21, 2022

(30) Foreign Application Priority Data

May 28, 2019 (KR) ..... 10-2019-0062508

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/42*** | (2006.01) |

(52) U.S. Cl.
CPC ..... *C22C 38/58* (2013.01); *C22C 38/001* (2013.01); *C22C 38/002* (2013.01); *C22C 38/02* (2013.01); *C22C 38/42* (2013.01)

(58) Field of Classification Search
None
See application file for complete search history.

(56) References Cited

U.S. PATENT DOCUMENTS

| | | | |
|---|---|---|---|
| 2009/0041613 | A1 | 2/2009 | Suzuki et al. |
| 2012/0034126 | A1 | 2/2012 | Nylof et al. |
| 2015/0315684 | A1 | 11/2015 | Eguchi et al. |

FOREIGN PATENT DOCUMENTS

| | | | | | |
|---|---|---|---|---|---|
| CN | 101381853 | A | * | 3/2009 | |
| CN | 102605291 | A | | 7/2012 | |
| CN | 103540863 | A | | 1/2014 | |
| CN | 110144523 | A | | 8/2019 | |
| EP | 2226406 | B1 | * | 1/2016 | ..... C22C 38/001 |
| EP | 3674434 | A1 | | 7/2020 | |
| JP | H0686645 | B2 | * | 11/1994 | |
| JP | 2010-121162 | A | | 6/2010 | |
| JP | 2012172211 | A | * | 9/2012 | |
| JP | 2014-189800 | A | | 10/2014 | |
| KR | 10-2009-0017085 | A | | 2/2009 | |
| KR | 10-2015-0074697 | A | | 7/2015 | |
| KR | 10-2015-0075182 | A | | 7/2015 | |
| KR | 10-1952808 | B1 | | 2/2019 | |
| WO | 2017/209431 | A1 | | 12/2017 | |
| WO | 2019/039768 | A1 | | 2/2019 | |

OTHER PUBLICATIONS

Machine translation of JPH06-86645B2. (Year: 1994).*
Machine translation of JP 2012-172211A. (Year: 2012).*
Machine translation of CN101381853A. (Year: 2009).*
Chinese Office Action dated Apr. 2, 2022 issued in Chinese Patent Application No. 202080039688.8 (with English translation).
International Search Report and Written Opinion dated Oct. 7, 2020 issued in International Patent Application No. PCT/KR2020/007052 (with English translation).
Korean Notice of Allowance dated Feb. 24, 2021 issued in Korean Patent Application No. 10-2019-0062508.
Korean Office Action dated Sep. 25, 2020 issued in Korean Patent Application No. 10-2019-0062508.
Extended European Search Report dated Jul. 20, 2022 issued in European Patent Application No. 20814107.7.
Chinese Office Action dated Oct. 12, 2022 issued in Chinese Patent Application No. 202080039688.8 (with English translation).

* cited by examiner

*Primary Examiner* — Xiaowei Su
(74) *Attorney, Agent, or Firm* — Morgan Lewis & Bockius LLP

(57) ABSTRACT

Provided is an austenitic stainless steel having excellent hot workability and exhibiting enhanced corrosion resistance of welded parts of hot-rolled and cold-rolled materials. The austenitic stainless steel having excellent corrosion resistance of welded parts according to an embodiment of the present disclosure includes, in percent (%) by weight, 0.02 to 0.07% of C, 0.2 to 0.7% of Si, 2.5 to 4.0% of Mn, 2.5 to 4.0% of Ni, 17.0 to 19.0% of Cr, less than 0.1% of P, less than 0.01% of S, 1.0 to 3.0% of Cu, 0.1 to 0.2% of N, and the remainder of Fe and other inevitable impurities, wherein a crack resistance index (CRN) represented by Formula (1) below is equal to or greater than 0.

$$CRN=542+715C-27Si-1.49Mn+38.8Ni-52.5Cr+35.8Cu+939N \quad (1).$$

12 Claims, No Drawings

AUSTENITIC STAINLESS STEEL WITH EXCELLENT CORROSION RESISTANCE OF WELDED PART

CROSS-REFERENCE OF RELATED APPLICATIONS

This application is the U.S. National Phase under 35 U.S.C. § 371 of International Patent Application No. PCT/KR2020/007052, filed on May 29, 2020, the entire disclosure of which is incorporated by reference herein.

TECHNICAL FIELD

The present disclosure relates to an austenitic stainless steel, and more particularly, to an austenitic stainless steel having excellent hot workability and exhibiting excellent corrosion resistance of welded parts of hot-rolled and cold-rolled materials by adjusting composition ratio of alloy components.

BACKGROUND ART

Strain-hardened metastable austenitic stainless steels, represented by STS304 and STS301 steels, have been widely used for various purposes due to excellent properties such as workability and corrosion resistance. However, these steel types are disadvantageous in that costs of materials increase due to a high Ni content. Particularly, not only because the supply of raw materials had recently been unstable due to wild fluctuation in prices of Ni raw materials but also because prices of steels considerably fluctuate thereby, it is difficult to stably maintain supply prices. Therefore, demands for Ni-saving type austenitic stainless steels with a reduced Ni content have recently been raised by various consumers.

In conventional Ni-saving type austenitic stainless steels, prices are fundamentally lowered by reducing the Ni content below a predetermined level and 4 wt % or more of Mn is generally added to compensate for stability of an austenite phase decreased by the lowered Ni content. However, in the case where a large amount of Mn is added, Mn fumes are generated in large quantities during a steelmaking process, and thus there is a demand for improvement in terms of the environment. In addition, there are problems of decreased productivity in the manufacturing process due to formation of steel-making inclusions (MnS) caused by a high Mn content and deteriorated mechanical properties such as surface corrosion resistance and elongation of finally obtained cold rolled materials.

To solve these problems, it is preferable to reduce the Mn content. However, when the Mn content is lowered below a predetermined level in the Ni-saving type austenitic stainless steels, stability of an austenite phase deteriorates so that a large amount of delta δ-ferrite is formed during a casting process, thereby inducing quality problems such as edge cracks and surface defects in slabs during hot rolling.

When the metastable austenitic stainless steel is used as a separator of fuel cells by welding, there is a high possibility of considerable intergranular corrosion by heat of a high temperature in heat-affected zones. Such intergranular corrosion is referred to as sensitization, and this is because a Cr carbide in the form of $Cr_{23}C_6$ precipitates along grain boundaries and a Cr-deficient region having a lower Cr concentration, compared to a base material, is formed around the grain boundaries.

In the case where a current collector and a separator formed of stainless steel materials are locally corroded among components of a MCFC fuel cell, resistance increases by a non-conductive product generated by corrosion in the corroded portion and functions thereof as structural supports may be lost. This may cause performance deterioration of the entire fuel cell.

Patent Document 1 discloses a stainless steel including a ratio of twin grain boundaries increased by 30% or more and further including 0.05 to 3.0% of Mo to improve intergranular corrosion resistance. In order to increase the ratio of twin grain boundaries by 30% or more, an additional heat-treatment process is required, and a stainless steel including Mo cannot be considered as the best solution in consideration of productivity and economic feasibility.

Although Patent Document 2 discloses a ferritic stainless steel in which a Cr carbonitride is inhibited, study on inhibiting intergranular corrosion of an austenitic stainless steel with a high N content is not disclosed.

(Patent Document 1) Japanese Patent Publication No. 2005-015896 (Jan. 20, 2005)

(Patent Document 2) Korean Patent Publication No. 10-2016-0014685 (Feb. 11, 2016)

DISCLOSURE

Technical Problem

The present disclosure provides an austenitic stainless steel having excellent hot workability and exhibiting intergranular corrosion resistance of welded parts by adjusting a composition and component ratio of the austenitic stainless steel.

Technical Solution

An embodiment of the present disclosure provides an austenitic stainless steel having excellent corrosion resistance of welded parts, the austenitic stainless steel including, in percent (%) by weight, 0.02 to 0.07% of carbon (C), 0.2 to 0.7% of silicon (Si), 2.5 to 4.0% of manganese (Mn), 2.5 to 4.0% of nickel (Ni), 17.0 to 19.0% of chromium (Cr), less than 0.1% of phosphorus (P), less than 0.01% of sulfur (S), 1.0 to 3.0% of copper (Cu), 0.1 to 0.2% of nitrogen (N), and the remainder of iron (Fe) and other inevitable impurities, wherein a crack resistance index (CRN) value, represented by Formula (1) below, of the austenitic stainless steel is equal to or greater than 0:

$$CRN=542+715C-27Si-1.49Mn+38.8Ni-52.5Cr+35.8Cu+939N \quad (1)$$

(wherein, C, Si, Mn, Ni, Cr, Cu, and N refer to contents (wt %) of the elements, respectively).

In addition, according to an embodiment of the present disclosure, an intergranular corrosion index (ICN) represented by Formula (2) below may be equal to or greater than 0.

$$ICN=32.7-265C+0.74Si+2.49Mn+2.77Ni-1.82Cr-1.13Cu+28.2N \quad (2)$$

In addition, according to an embodiment of the present disclosure, a pitting resistance equivalent number (PREN) represented by Formula (3) below may be equal to or greater than 18, and a pitting potential is equal to or greater than 300 mV.

$$PREN=Cr+16N-0.5Mn \quad (3)$$

In addition, according to an embodiment of the present disclosure, the austenitic stainless steel may further include, in percent (%) by weight, 0.001 to 0.005% of boron (B) and 0.001 to 0.003% of calcium (Ca).

Advantageous Effects

The austenitic stainless steel having excellent corrosion resistance of welded parts according to an embodiment of the present disclosure may have excellent hot workability by inhibiting formation of δ-ferrite during a process of reheating a slab by controlling a composition ratio of alloy components. As a result, occurrence of cracks in the surface and edge portions may be prevented during a hot rolling process and quality problems may be solved.

In addition, enhanced corrosion resistance of hot-rolled and cold-rolled materials may be obtained by inhibiting formation of a carbonitride in heat-affected zones of welded parts by optimizing the contents of C and N among the alloy components.

Also, excellent corrosion resistance at a level similar to that of STS304 or STS301 may be obtained.

BEST MODE

An austenitic stainless steel having excellent corrosion resistance of welded parts according to an embodiment of the present disclosure includes, in percent (%) by weight, 0.02 to 0.07% of carbon (C), 0.2 to 0.7% of silicon (Si), 2.5 to 4.0% of manganese (Mn), 2.5 to 4.0% of nickel (Ni), 17.0 to 19.0% of chromium (Cr), less than 0.1% of phosphorus (P), less than 0.01% of sulfur (S), 1.0 to 3.0% of copper (Cu), 0.1 to 0.2% of nitrogen (N), and the remainder of iron (Fe) and other inevitable impurities, wherein a crack resistance index (CRN) value, represented by Formula (1) below, is equal to or greater than 0.

$$CRN=542+715C-27Si-1.49Mn+38.8Ni-52.5Cr+35.8Cu+939N. \quad (1)$$

MODES OF THE INVENTION

Hereinafter, embodiments of the present disclosure will be described in detail with reference to the accompanying drawings. The following embodiments are provided to fully convey the idea of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

As a method of preventing formation of a Cr carbonitride at grain boundaries as described above, the contents of C and N may be controlled or a welded part may be subjected to solid solution treatment. However, it is difficult to apply solid solution treatment after welding due to additional cost increases and restrictions in processes. Also, it is difficult to control the contents of C+N since a large amount of N is added to obtain corrosion resistance of a base material at a high temperature.

Therefore, the present inventors have obtained hot workability by inhibiting formation of cracks in the surface or edge portions during hot working by deriving a crack resistance index (CRN) via analysis of correlation between experimental hot workability evaluation results of various alloy components and predicted δ-ferrite, and also have derived alloy components for excellent hot workability and excellent corrosion resistance of a welded part and a base material by analyzing correlation between the alloy components and a Cr carbonitride precipitation behavior.

An austenitic stainless steel having excellent corrosion resistance of welded parts according to an embodiment of the present disclosure include, in percent (%) by weight, 0.02 to 0.07% of carbon (C), 0.2 to 0.7% of silicon (Si), 2.5 to 4.0% of manganese (Mn), 2.5 to 4.0% of nickel (Ni), 17.0 to 19.0% of chromium (Cr), less than 0.1% of phosphorus (P), less than 0.01% of sulfur (S), 1.0 to 3.0% of copper (Cu), 0.1 to 0.2% of nitrogen (N), and the remainder of iron (Fe) and other inevitable impurities.

Hereinafter, reasons for numerical limitations on contents of alloy components in the embodiment of the present disclosure will be described. Hereinafter, the unit is wt % unless otherwise stated.

The content of C is from 0.02 to 0.07%.

C is an element effective for stabilization of an austenite phase. However, an excess of C may not only deteriorate cold workability due to solid solution strengthening effects but also induce grain boundary precipitation of a Cr carbide caused by latent heat of a heat-affected zone of a welded part and latent heat remained after a hot rolling and coiling process, so that ductility, toughness, corrosion resistance, and the like may be adversely affected thereby. For this reason, an upper limit thereof is set to 0.07%. Also, 0.02% or more of C may be added to stabilize the austenite phase as described above.

The content of Si is from 0.2 to 0.7%.

Si, serving as a deoxidizer during a steelmaking process, is effective for enhancing corrosion resistance, and this property is effective when added in an amount of 0.2% or more. However, because Si is an element effective for stabilizing a ferrite phase, an excess of Si may promote formation of δ-ferrite in a cast slab, thereby not only deteriorating hot workability but also deteriorating ductility and toughness of a steel material due to solid solution strengthening effects. Due to these reasons, an upper limit thereof is set to 0.7%.

The content of Mn is from 2.5 to 4.0%.

Mn, as an element for stabilizing an austenite phase added as a Ni substitute, is effective for enhancing cold rollability by inhibiting formation of strain-induced martensite, and this property is effective when added in an amount of 2.5% or more. However, an excess of Mn causes an increase in S-based inclusions (MnS) leading to deterioration of ductility, toughness, and corrosion resistance of a steel material. Thus, an upper limit thereof is set to 4.0%.

The content of Ni is from 2.5 to 4.0%.

Ni, as an element effective for stabilizing an austenite phase, is essential to obtain satisfactory hot workability and cold workability. Particularly, even when more than a certain amount of Mn is added, addition of 2.5% or more of Ni is essential. However, because Ni is an expensive element, costs of raw materials may increase in the case of adding a large amount of Ni. Therefore, an upper limit thereof is set to 4.0%.

The content of Cr is from 17.0 to 19.0%.

Cr is not only an element necessary to obtain corrosion resistance required for stainless steels but also effective for inhibiting formation of a martensite phase, and this property is effective when added in an amount of 17.0% or more. However, an excess of Cr promotes formation of δ-ferrite in a slab causing deterioration of hot workability. Thus, an upper limit thereof is set to 19.0%.

The content of P is less than 0.1%.

Because P deteriorates corrosion resistance or hot workability, an upper limit thereof is set to 0.1%.

The content of S is less than 0.01%.

Because S deteriorates corrosion resistance or hot workability, an upper limit thereof is set to 0.01%.

The content of Cu is from 1.0 to 3.0%.

Cu, as an element for stabilizing an austenite phase, is effective for softening of a material. In order to express such softening effects, Cu needs to be added in an amount of 1.0% or more. However, an excess of Cu not only increases costs of raw materials but also causes fragility during hot working. Thus, an upper limit thereof is set to 3.0%.

The content of N is from 0.1 to 0.2%.

N is an element effective for stabilizing an austenite phase and enhancing corrosion resistance, and this property is effective when added in an amount of 0.1% or more. However, an excess of N may not only deteriorate cold workability due to solid solution strengthening effects but also cause defects in quality due to pores formed during a casting process. Thus, an upper limit thereof is set to 0.2%.

In addition, according to an embodiment of the present disclosure, the austenitic stainless steel may further include at least one of boron (B) in an amount of 0.001 to 0.005% and calcium (Ca) in an amount of 0.001 to 0.003%.

B is an element effective for obtaining satisfactory surface quality by inhibiting occurrence of cracks during a casting process, and this property is effective when added in an amount of 0.001%. However, an excess of B may form a nitride (BN) on the surface of a product during an annealing/acid pickling process, thereby deteriorating the surface quality. Thus, an upper limit thereof is set to 0.005%.

Ca improves purity of a product by inhibiting formation of MnS steelmaking inclusions, which are formed at grain boundaries in the case of including a high Mn content, and this property is effective when added in an amount of 0.001%. However, an excess of Ca may deteriorate hot workability and surface quality of a product due to formation of Ca-based inclusions. Thus, an upper limit thereof is set to 0.003%.

It is known that hot workability of the austenitic stainless steel including a high Mn content is correlated to a fraction of δ-ferrite distributed in a slab. This is because cracks occur due to different resistance of austenite and ferrite against strains applied during a rolling process at a high temperature when austenite and ferrite are present in combination. It is necessary to design alloy components and derive hot working conditions to inhibit formation of 6-ferrite to obtain hot workability. However, referring to the above-described properties of the components of the present disclosure, when large amounts of solid solution strengthening elements such as C and N are added, there is a high possibility of occurrence of cracks in the surface of a material due to high hot rolling load during a hot working process at a low temperature. Therefore, it is preferable to perform a hot rolling process at a temperature not causing problems in the process.

Specifically, by examining the quality of the surface and edges of a hot-rolled material, occurrence of cracks was used to evaluate hot workability and a fraction of a δ-ferrite phase was predicted by phase analysis using computer simulation performed on alloy components. By analyzing correlation between the experimental hot workability evaluation results and the predicted δ-ferrite, a crack resistance index (CRN) range represented by Formula 1 below was derived.

The austenitic stainless steel having excellent corrosion resistance of welded parts according to an embodiment of the present disclosure has a crack resistance index (CRN), represented by Formula 1 below, of equal to or greater than 0.

$$CRN=542+715C-27Si-1.49Mn+38.8Ni-52.5Cr+35.8Cu+939N \quad (1)$$

When the crack resistance index (CRN) is 0 or more, cracks may not occur in the surface and edge parts during a hot working process.

In addition, although large amounts of interstitial elements such as C and N need to be added to control the δ-ferrite as described above, coarse carbide is locally formed in the case of applying a welding technique to a steel including large amounts of C and N, resulting in formation of a non-uniform structure. Particularly, in the case of a steel material including a large amount of C, a large amount of precipitates of a Cr carbide ($Cr_{23}C_6$) are formed around grain boundaries of a heat-affected zone (HAZ) of the welded part, and thus intergranular corrosion may be caused. Thus, by controlling the amount of precipitates via examination on correlation between the alloy components and precipitation of Cr carbides, corrosion resistance of the welded part may be enhanced.

Specifically, after simulating a welded part using a hot-rolled material, occurrence of intergranular corrosion was quantified. By using computer simulation performed on alloy components, incubation time of the Cr carbide was predicted. By analyzing correlation between the experimental intergranular corrosion evaluation results and predicted precipitation of the Cr carbide, an intergranular corrosion index (ICN) represented by Formula (2) below was derived.

The austenitic stainless steel having excellent corrosion resistance of welded parts according to an embodiment of the present disclosure may have an intergranular corrosion index (ICN), represented by Formula (2) below, of equal to or greater than 0.

$$ICN=32.7-265C+0.74Si+2.49Mn+2.77Ni-1.82Cr-1.13Cu+28.2N \quad (2)$$

When the intergranular corrosion index (ICN) is equal to or greater than 0, a welded part may have excellent intergranular corrosion resistance, and thus cracks may not occur in a heat-affected zone of the welded part in a U band test after intergranular corrosion.

In addition, because it is required to obtain a corrosion resistance similar to that of a conventional stainless steel STS304 or STS301, it is necessary to maintain a pitting resistance equivalent number (PREN) of alloy components above a certain level.

Thus, according to an embodiment of the present disclosure, a pitting resistance equivalent number (PREN) represented by Formula (3) below may be 18 or more.

$$PREN=Cr+16N-0.5Mn \quad (3)$$

Hereinafter, the present disclosure will be described in more detail with reference to the following examples.

EXAMPLES 200 t slabs were prepared by ingot casting using various alloy components shown in Table 1 below, heated at 1,240° C. for 2 hours, and hot-rolled to 4 t. Then, the quality of the surface and edges of the hot-rolled material was inspected based on occurrence of cracks to evaluate hot workability. Then, the hot-rolled steel sheets were acid-pickled and cold-rolled to 2.4 t. The cold-rolled steel sheets were annealed at 1,100° C. and acid-pickled.

TABLE 1

| Example | C | Si | Mn | Ni | Cr | P | S | Cu | N |
|---|---|---|---|---|---|---|---|---|---|
| Comparative Example 1 | 0.08 | 0.4 | 2.9 | 3.5 | 17.9 | 0.02 | 0.004 | 1.7 | 0.17 |
| Comparative Example 2 | 0.11 | 0.5 | 3.9 | 3.5 | 18.4 | 0.02 | 0.003 | 1.5 | 0.2 |
| Comparative Example 3 | 0.05 | 0.5 | 3.8 | 3.6 | 17.8 | 0.03 | 0.004 | 1.1 | 0.14 |
| Comparative Example 4 | 0.09 | 0.3 | 4.6 | 2.4 | 17.2 | 0.04 | 0.005 | 0.5 | 0.16 |
| Comparative Example 5 | 0.05 | 0.6 | 3.7 | 3.9 | 17.6 | 0.02 | 0.002 | 1.4 | 0.08 |
| Example 1 | 0.06 | 0.3 | 3.7 | 3.6 | 17.7 | 0.03 | 0.006 | 1.7 | 0.18 |
| Example 2 | 0.07 | 0.2 | 3.2 | 3.9 | 18.1 | 0.03 | 0.004 | 1.9 | 0.19 |
| Example 3 | 0.05 | 0.4 | 3.6 | 3.8 | 17.4 | 0.02 | 0.003 | 1.6 | 0.16 |

Subsequently, for evaluation of corrosion resistance of welded parts, the welded parts were simulated by a bead-on-plate method using general-TIG welding.

In addition, a fraction of a δ-ferrite phase was predicted by phase analysis of the alloy components. The crack resistance index (CRN) of Formula (1) was derived by analyzing correlation between the experimental hot workability evaluation results and predicted δ-ferrite and shown in in Table 2.

In addition, intergranular corrosion of the welded parts was evaluated for analysis of corrosion resistance of the welded parts, and the results are shown in Table 2.

Also, incubation time of the Cr carbide was predicted by phase analysis of the alloy components. The intergranular corrosion index (ICN) of Formula (2) above was derived by analyzing correlation between the experimental intergranular corrosion evaluation results and the predicted incubation time of the Cr carbide and shown in Table 2.

In addition, for analysis of corrosion resistance of the base material, a salt water spray cyclic test and a pitting corrosion resistance test were performed on the base material, and the results are shown in Table 2 below.

Evaluation of each corrosion resistance item was performed by applying the following methods.

Intergranular corrosion was evaluated by a Modified Strauss method using a solution of $CuSO_4 \cdot H_2O$ (100 g)+distilled water (700 cc)+$H_2SO_4$ (95%, 100 ml) supplemented with distilled water to a total volume of 1,000 cc with a sample size of 50×20 mm. After the sample was completely immersed therein continuously for 24 hours at a boiling point, occurrence of cracks (R=2 t) was examples using a U-band test. A case where no crack was observed was regarded as pass, and a case where cracks were observed was regarded as fail.

They were expressed by symbols O and X, respectively.

The salt water spray cyclic test of the base material was performed under the following conditions: Acidified Salt Mist Condition (spraying a 5% NaCl solution, 35° C.±1° C., 2 Hr)→Dry Condition (60° C.±1° C., relative humidity <30%, 4 Hr)→Wet Condition (50° C.±1° C., relative humidity >95%, 2 Hr), as one cycle. After performing 30 cycles, a case where no corrosion was observed in the welded part and the base material was regarded as pass, and a case where corrosion was observed was regarded as fail. They were expressed by symbols O and X, respectively.

The pitting corrosion resistance of the base material was evaluated using the cold annealed material having the composition shown in Table 1. The evaluation was performed using an electrochemical method called an anodic polarization test. The conditions of the polarization test were as follows. After polishing the surface of the sample using #600 sandpaper, only an area of 1 $cm^2$ of the surface was exposed and the rest of the surface was covered with a masking tape such that a solution for the test was not in contact with the rest of the surface. Then, the sample was immersed in a 3.5% NaCl solution maintained at 30° C. and a potential was applied thereto to measure a potential where pitting corrosion occurs.

TABLE 2

| | Hot workability | | | Corrosion resistance of welded part | | Corrosion resistance of base material | |
|---|---|---|---|---|---|---|---|
| Example | Crack | CRN | PREN | Evaluation of intergranular corrosion | ICN | Evaluation of salt water spray cycle | Pitting potential (mV) |
| Comparative Example 1 | ○ | 1 | 19.2 | x | −1.0 | ○ | 378 |
| Comparative Example 2 | ○ | 13 | 19.7 | x | −6.2 | ○ | 386 |
| Comparative Example 3 | x | −65 | 18.1 | ○ | 9.6 | ○ | 314 |
| Comparative Example 4 | x | −50 | 17.5 | x | −0.2 | x | 286 |
| Comparative Example 5 | x | −91 | 17.0 | ○ | 8.6 | x | 273 |
| Example 1 | ○ | 12 | 18.7 | ○ | 7.1 | ○ | 342 |
| Example 2 | ○ | 29 | 19.5 | ○ | 3.3 | ○ | 392 |
| Example 3 | ○ | 3 | 18.2 | ○ | 10.3 | ○ | 324 |

Referring to the results of hot workability shown in Table 2, cracks occurred in the surface and edge portions during a hot rolling process, and the crack resistance index (CRN) was less than 0 in the cases of Comparative Examples 3, 4, and 5. On the contrary, since cracks did not occur in the surface and edge portions during a hot rolling process in the cases of Comparative Examples 1 and 2 and Examples 1, 2, and 3, it was confirmed that excellent hot workability may be obtained when the crack resistance index (CRN) derived from the fraction of the δ-ferrite phase was equal to or greater than 0.

Referring to the results of corrosion resistance of welded parts shown in Table 2, cracks occurred in the intergranular corrosion evaluation and the intergranular corrosion index (ICN) was less than 0 in the cases of Comparative Examples 1, 2, and 4. On the contrary, in the cases of Comparative Examples 3 and 5 and Examples 1, 2, and 3, corrosion and cracks did not occur in the intergranular corrosion evaluation. This indicates that intergranular corrosion of the welded parts may be inhibited when the obtained intergranular corrosion index (ICN) was equal to or greater than 0.

Referring to the results of corrosion resistance of the base material shown in Table 2, corrosion was observed in a large area in the salt water spray cyclic test of the base material in the cases of Comparative Examples 4 and 5 where the PREN value was less than 18, and relatively low pitting potential, which is lower than 300, was observed in the pitting corrosion resistance evaluation. For reference, when the pitting corrosion resistance of general STS304 was evaluated under the same conditions as described above, a pitting potential thereof was about 280 to 320 mV. Thus, it can be seen that those of Comparative Examples 4 and 5 have inferior pitting corrosion resistance compared to STS304. However, in the cases of Comparative Examples 1, 2, and 3 and Examples 1, 2, and 3 having a PREN value of 18 or more, corrosion was not observed in the salt water spray cyclic test of the base material and the pitting potential also indicated similar or enhanced pitting corrosion resistance compared to STS304.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The austenitic stainless steel according to the present disclosure is economically feasible by reducing the Ni content and has excellent corrosion resistance of welded parts, thereby having excellent corrosion resistance similar to that of STS304 or STS301.

The invention claimed is:

1. An austenitic stainless steel comprising welded parts and a base material, and both the welded parts and the base material having corrosion resistance of welded parts, the austenitic stainless steel comprising, in percent (%) by weight, 0.02 to 0.07% of carbon (C), 0.2 to 0.7% of silicon (Si), 2.5 to 4.0% of manganese (Mn), 2.5 to 4.0% of nickel (Ni), 17.4 to 18.1% of chromium (Cr), less than 0.1% of phosphorus (P), less than 0.01% of sulfur(S), 1.6 to 1.9% of copper (Cu), 0.1 to 0.2% of nitrogen (N), and the remainder of iron (Fe) and other inevitable impurities, wherein a crack resistance index (CRN) value, represented by Formula (1) below, is equal to or greater than 0, and an intergranular corrosion index (ICN) represented by Formula (2) below is equal to or greater than 0, $$CRN=542+715C-27Si-1.49Mn+38.8Ni-52.5Cr+35.8Cu+939N \quad (1)$$

$$ICN=32.7-265C+0.74Si+2.49Mn+2.77Ni-1.82Cr-1.13Cu+28.2N \quad (2)$$

wherein, C, Si, Mn, Ni, Cr, Cu, and N refer to contents (wt %) of respective elements.

2. The austenitic stainless steel of claim 1, wherein a pitting resistance equivalent number (PREN) represented by Formula (3) below is equal to or greater than 18, and a pitting potential measured by a 3.5% NaCl solution at 30° C. is equal to or greater than 300 mV:

$$PREN=Cr+16N-0.5Mn \quad (3).$$

3. The austenitic stainless steel of claim 1, further comprising, in percent (%) by weight, 0.001 to 0.005% of boron (B) and 0.001 to 0.003% of calcium (Ca).

4. The austenitic stainless steel of claim 1, wherein the crack resistance index (CRN) value represented by Formula (1) is 3 or more and 29 or less.

5. The austenitic stainless steel of claim 1, wherein the intergranular corrosion index (ICN) represented by Formula (2) is 3.0 or more and 10.3 or less.

6. The austenitic stainless steel of claim 1, wherein the pitting resistance equivalent number (PREN) represented by Formula (3) is 18.2 or more and 19.5 or less.

7. The austenitic stainless steel of claim 1, wherein the austenitic stainless steel comprises, in percent (%) by weight, 0.05 to 0.07% of carbon (C).

8. The austenitic stainless steel of claim 1, wherein the austenitic stainless steel comprises, in percent (%) by weight, 0.2 to 0.4% of silicon (Si).

9. The austenitic stainless steel of claim 1, wherein the austenitic stainless steel comprises, in percent (%) by weight, 3.2 to 4.0% of manganese (Mn).

10. The austenitic stainless steel of claim 1, wherein the austenitic stainless steel comprises, in percent (%) by weight, 3.6 to 3.9% of nickel (Ni).

11. The austenitic stainless steel of claim 1, wherein the austenitic stainless steel comprises, in percent (%) by weight, 0.03% or less of phosphorus (P).

12. The austenitic stainless steel of claim 1, wherein the austenitic stainless steel comprises, in percent (%) by weight, 0.006% of sulfur(S).

* * * * *